US007091459B2

(12) United States Patent
Kim

(10) Patent No.: US 7,091,459 B2
(45) Date of Patent: Aug. 15, 2006

(54) COOKING APPARATUS

(75) Inventor: Hyung Min Kim, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/921,859

(22) Filed: Aug. 20, 2004

(65) Prior Publication Data

US 2005/0127059 A1 Jun. 16, 2005

(30) Foreign Application Priority Data

Dec. 10, 2003 (KR) ..... 10-2003-0089775

(51) Int. Cl.
*H05B 6/64* (2006.01)

(52) U.S. Cl. ..... 219/758; 219/391; 219/715; 219/716; 219/385; 362/92; 126/21 A; 126/237; 361/694; 361/695

(58) Field of Classification Search ..... 219/385, 219/386, 387, 528, 529, 390, 391, 758, 715–16, 219/405, 411; 126/21 A, 237; 361/694, 361/695; 118/724, 725, 50.1; 362/92; 392/416, 392/418

See application file for complete search history.

(56) References Cited

U.S. PATENT DOCUMENTS 5,712,468 A * 1/1998 Ace ..... 219/758
6,093,919 A 7/2000 Seo et al.

* cited by examiner

*Primary Examiner*—Shawntina Fuqua
(74) *Attorney, Agent, or Firm*—Staas & Halsey LLP

(57) ABSTRACT

A cooking apparatus, in which lamps are conveniently and quickly replaced, including a lamp assembly having a lamp casing accommodating lamps and covering an irradiation hole formed in a front panel, and a transparent plate completely covering the irradiation hole. The lamp casing is screwed to the front panel, or is hinged to the front panel to allow rotation of the lamp casing. An open bottom of the lamp casing is covered with a lamp cover screwed or hooked to the lamp casing. A front cover is screwed to the front panel to cover the lamp assembly, or is hinged to the front panel to allow rotation thereof.

21 Claims, 6 Drawing Sheets

COOKING APPARATUS

CROSS-REFERENCE TO RELATED APPLICATIONS

This application claims the benefit of Korean Patent Application No. 2003-89775, filed Dec. 10, 2003 in the Korean Intellectual Property Office, the disclosure of which is incorporated herein by reference.

BACKGROUND OF THE INVENTION

1. Field of the Invention

The present invention relates generally to a cooking apparatus and, more particularly, to a cooking apparatus, in which a lamp assembly having lamps is mounted on an upper portion of a front panel located at a front end of a cooing cavity, thereby not only illuminating the cooking cavity, but also allowing the lamps to be conveniently and quickly replaced.

2. Description of the Related Art

In general, cooking apparatuses, such as a microwave oven and an electrical oven, are provided with cooking cavities therein and cook food in the cooking cavities by radiating microwaves, or heat that is generated by electrical heaters, to the food.

Other cooking apparatuses use overheated steam to uniformly heat food by supplying the overheated steam to cooking cavities, thus preventing the food from being locally burned, and to allow a cooking temperature to be easily adjusted by adjusting a temperature of and an amount of the overheated steam, thus improving the taste of the cooked food.

In the cooking apparatuses, lamp assemblies having lamps are mounted inside the cooking cavities to illuminate the cooking cavities and, thus, allow users to observe food being cooked. When the lamp assemblies are mounted inside the cooking cavities as described above, the structures of the lamp assemblies become complicated, and it is difficult, and requires excessive time, to replace the lamps.

Furthermore, when lamp assemblies are mounted inside the cooking cavities of the cooking apparatuses, openings are provided through inside walls of the cooking cavities. Heat is easily discharged from the cooking cavities through the openings and, thus, energy is lost. Additionally, because the lamp assemblies are mounted inside the cooking cavities, the cooking cavities cannot have curved shapes.

SUMMARY OF THE INVENTION

It is an aspect of the present invention to provide a cooking apparatus, which allows lamps placed in a lamp assembly to be easily and quickly replaced.

It is another aspect of the present invention to provide a cooking apparatus in which a lamp assembly is mounted on a front panel, thus reducing a loss of heat from a cooking cavity and allowing the cooking cavity to have a curved shape.

Additional aspects and/or advantages of the invention will be set forth in part in the description which follows and, in part, will be obvious from the description, or may be learned by practice of the invention.

To achieve the above and/or other aspects of the present invention, there is provided a cooking apparatus that includes a cooking cavity open in a front thereof, a front panel defining a front periphery of the cooking cavity, and a lamp assembly mounted on the front panel to illuminate the cooking cavity from the front panel.

The front panel has an irradiation hole in an upper portion of the front panel, and the lamp assembly may include a lamp casing accommodating at least one lamp and covering a space in front of the irradiation hole, and a transparent plate covering the irradiation hole.

The transparent plate may be made of a heat-resistant material and is attached to the front panel to close the irradiation hole.

The lamp casing may have a flange, extending from at least one edge of the lamp casing, with screw holes to attach the lamp casing to the front panel using screws.

The lamp casing may be attached to the front panel by welding edges of the lamp casing to the front panel.

The lamp casing may be open at a back and a bottom thereof; have at least one socket, to which the at least one lamp is inserted, in an upper portion of an interior of the lamp casing; and have a lamp cover at the bottom of the lamp casing.

The lamp cover may be detachably attached to the bottom of the lamp casing by screws.

The lamp casing may have hook holes at both sides of the lamp casing, and the lamp cover may have hooks to detachably engage the hook holes.

The cooking apparatus may further include a front cover detachably attached to the front panel to surround the lamp assembly.

The front cover may be hinged to the front panel at both sides of an upper end of the front panel, and may be screwed to the front panel at both sides of a lower end of the front cover to expose the lamp assembly to an outside of the front cover by rotating the front cover upwards after unscrewing the front cover at the both sides of the lower end of the front cover.

Alternatively, the front cover may be screwed to the front panel at both sides of an upper end of the front panel and at both sides of a lower end of the front cover to expose the lamp assembly to an outside of the front cover by unscrewing screws from the front cover to separate the front cover from the front panel.

A bottom of the front cover and a bottom of the lamp casing may be arranged on an upper portion of the front panel to correspond to each other and the front cover may have an opening at the bottom of the front cover to allow access to the bottom of the lamp casing, with the front cover attached to the front panel.

The cooking cavity may be formed to be curved, and the cooking cavity may be supplied with overheated steam to cook food.

To achieve the above and/or other aspects of the present invention, there is provided a lamp assembly for a cooking apparatus having a front panel defining a front periphery of a cooking cavity and an irradiation hole in the front panel, the lamp assembly including a lamp casing accommodating one or more lamps and surrounding the irradiation hole; a transparent plate at a back of the lamp casing to cover the irradiation hole; and a lamp cover detachably attached to a bottom of the lamp casing using screws.

To achieve the above and/or other aspects of the present invention, there is provided a lamp assembly for a cooking apparatus having a front panel defining a front periphery of a cooking cavity, an irradiation hole in the front panel, and a front cover detachably attached to the front panel with an opening in a bottom of the front cover, the lamp assembly including a lamp casing accommodating one or more lamps and surrounding the irradiation hole, the lamp casing having hook holes at both sides thereof; a transparent plate at a back of the lamp casing to cover the irradiation hole; and a lamp cover detachably attached to a bottom of the lamp casing, the lamp cover having hooks at both ends thereof that engage the hook holes, the lamp cover having a smaller size than the opening in the bottom of the front cover, and the lamp cover being adjacent to the opening in the bottom of the front cover when the front cover is attached to the front panel.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
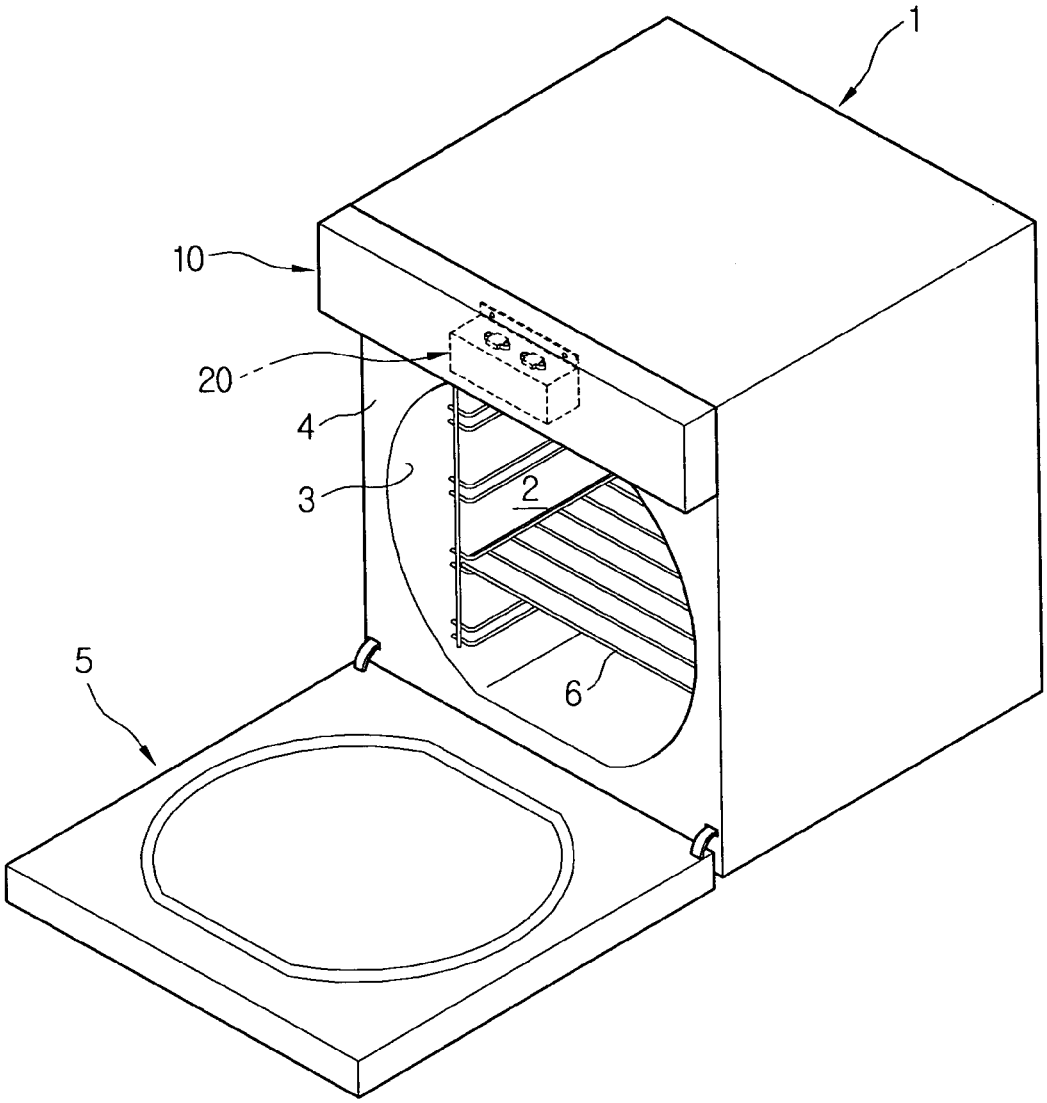
FIG. 1 is a perspective view of a cooking apparatus with a lamp assembly mounted on a front panel, according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a perspective view of a cooking apparatus with a lamp assembly 20 mounted on a front panel, according to the present invention. As depicted in FIG. 1, the cooking apparatus includes a housing 1 with a cooking cavity 2 therein and a door 5 attached to a front of the housing 1 to selectively open and close the cooking cavity 2.

The cooking cavity 2 is defined by a cavity wall 3, and a front panel 4 with an opening corresponding to the cavity wall 3 and placed in front of the cavity wall 3.

The cavity wall 3 is cylindrically shaped, and a rack 6 is suspended on the cavity wall 3 to allow food to be placed thereon. A steam generator (not shown) is located behind the housing 1 to supply overheated steam to the cooking cavity 2 to cook the food.

In the cooking apparatus, an electrical heater (not shown) or a magnetron (not shown), instead of the steam generator, may be provided, and food may be cooked using heat generated by the electrical heater or microwaves generated by the magnetron.

The lamp assembly 20 according to the present invention is mounted on an upper portion of the front panel 4 to illuminate the cooking cavity 2, so that a user can observe food being cooked from outside the cooking cavity 2 and easily put food into, and take food out of, the cooking cavity 2.

A front cover 10 is located in front of the upper portion of the front panel 4 to cover the lamp assembly 20. The front cover 10 may include a control panel (not shown) used to input the type of food and the cooking time to control cooking of the food.

Figure 2:
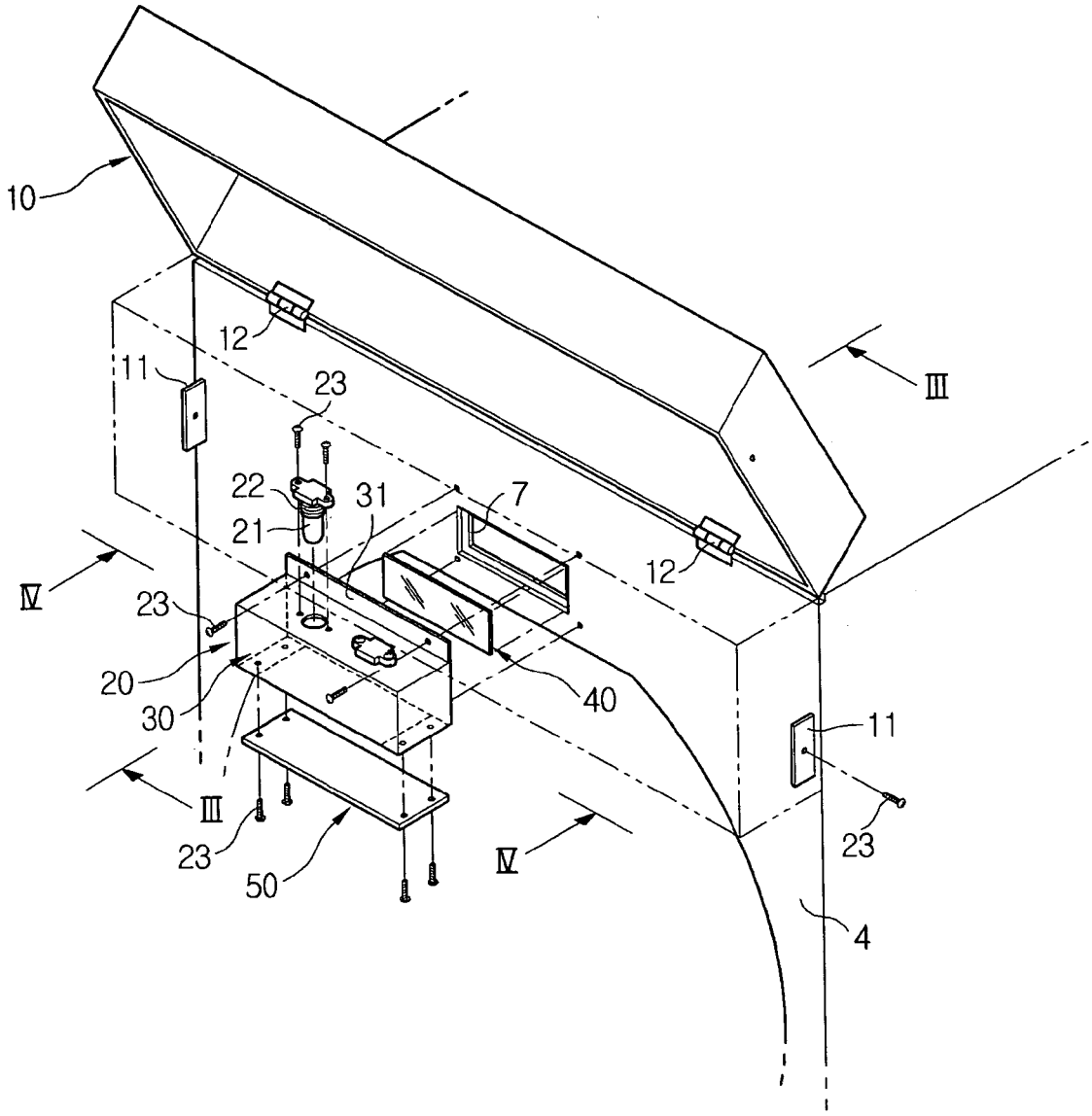
FIG. 2 is a partial perspective view showing a lamp assembly mounted in a front cover, according to a first embodiment of the present invention.
Figure 3:
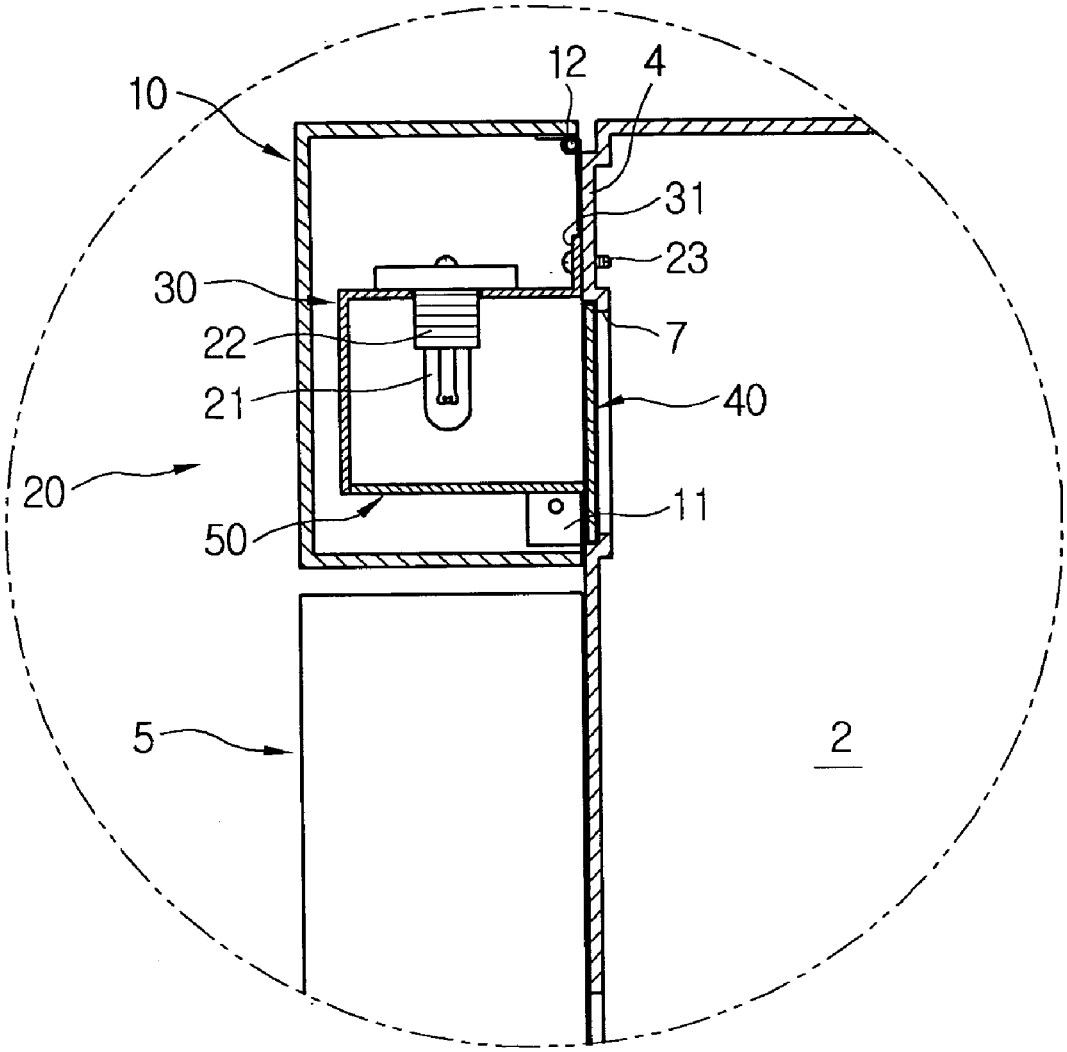
FIG. 3 is a cross-sectional view of the lamp assembly taken along line III—III of FIG. 2.
Figure 4:
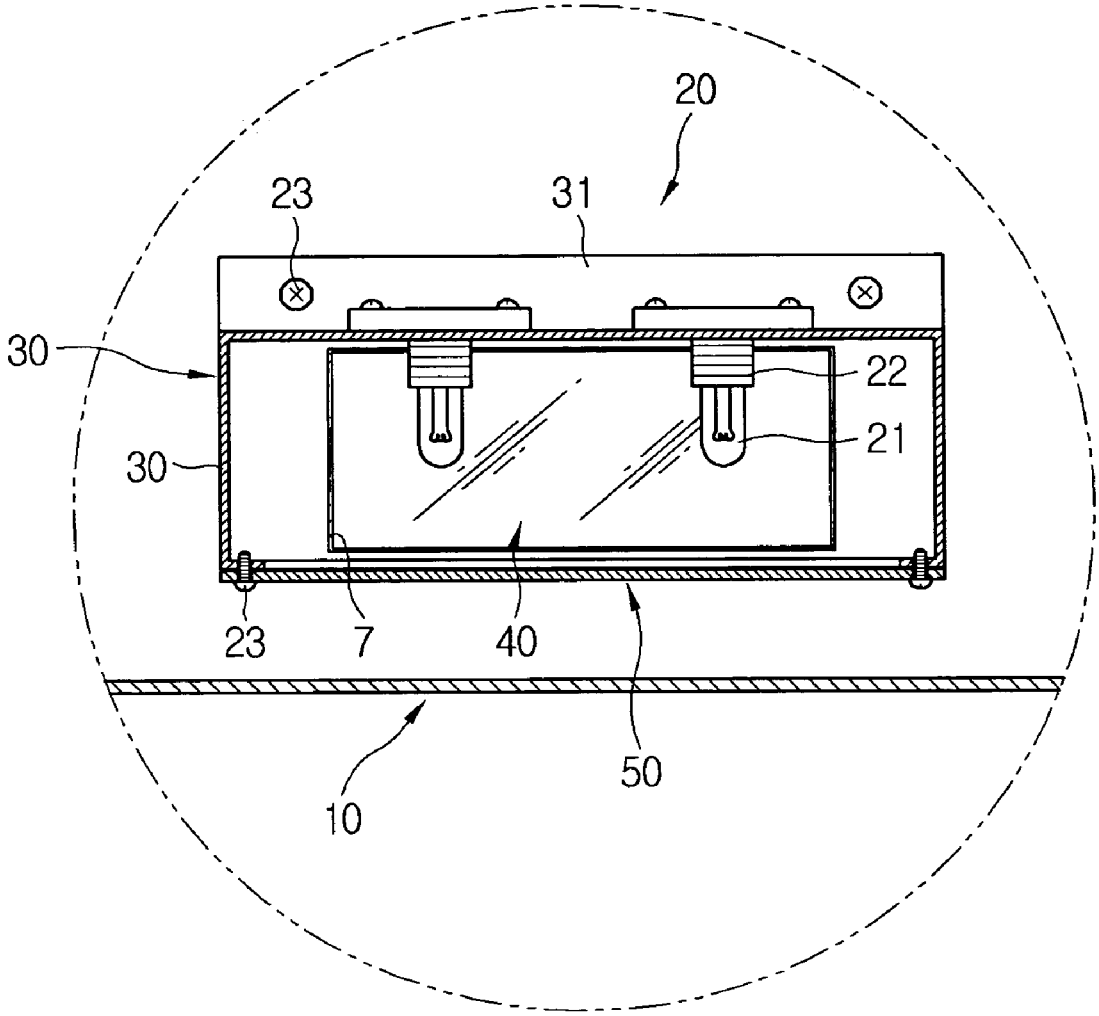
FIG. 4 is a cross-sectional view of the lamp assembly taken along line IV—IV of FIG. 2.

FIGS. 2 to 4 are views showing the lamp assembly according to a first embodiment of the present invention, which is located in the front panel 4. As shown in FIGS. 2 to 4, an irradiation hole 7 of a predetermined size is formed through the upper portion of the front panel 4 to allow light generated from the lamp assembly 20 to be radiated to the cooking cavity 2.

The lamp assembly 20 includes a lamp casing 30 to accommodate lamps and cover a space in front of the irradiation hole 7; a transparent plate 40 to prevent heat from being emitted from the cooking cavity 2 by closing the irradiation hole 7, and pass the light therethrough to the cooking cavity 2; a pair of lamps 21 to illuminate the cooking cavity 2; a pair of sockets 22 to mount the pair of lamps 21 in the lamp casing 30; and a lamp cover 50 to allow the lamps 21 mounted in the lamp casing 30 to be replaced.

The transparent plate 40 is made of a heat-resistant and transparent material, both to be resistant to heat generated from the cooking cavity 2 during cooking, and to allow light generated from the lamps 21 to be radiated to the cooking cavity 2 without blockage. The transparent plate 40 is attached to a vicinity of the irradiation hole 7 on an outside surface of the front panel 4 using a material, such as silicon or rubber, to seal the transparent plate 40 to the irradiation hole 7. The transparent plate 40 may be attached to an inner surface of the front panel 4 to close the irradiation hole 7.

The lamp casing 30 has a box shape with a back and a bottom thereof opened, and surrounds the irradiation hole 7 with only the bottom of the lamp casing 30 being opened. A flange 31 extends upwardly and has screw holes on an upper edge thereof to fasten the lamp casing 30 to the front panel 4 using screws.

Alternatively, flanges 31 may extend from both upper and lower back edges of the lamp casing 30 to fasten the lamp casing 30 to the front panel 4 using screws. As another alternative, an upper edge and both side edges of the lamp casing 30 may be welded to the front panel 4.

The sockets 22 are inserted into an inside of the lamp casing 30 through the top of the lamp casing 30, and are fastened to the lamp casing 30 with the lamps 21 being located within the lamp casing 30. See FIGS. 3 and 4.

The lamp cover 50 is fastened to a bottom of the lamp casing 30 by screws 23 to prevent light from leaking through the open bottom of the lamp casing 30 and to give access to the lamps 21 to replace the lamps 21 by unfastening the screws 23 from the lamp casing 30.

The front cover 10 is mounted on the front panel 4 to cover and surround the lamp assembly 20 and prevent the lamp assembly 20 from being exposed outside the cooking apparatus.

The front cover 10 is rotatably fastened to the front panel 4 by fastening both sides of a top edge of the front cover 10 to the front panel 4 using hinges 12 and fastening lower portions of both sides of the front cover 10 to tabs 11 projecting from both sides of the front panel 4, by placing screws 23 in screw holes in the tabs 11.

Accordingly, when the lamps 21 contained in the lamp casing 30 are replaced, a bottom of the front cover 10 is removed from the front panel 4 by unfastening the screws 23 in the tabs 11. Thereafter, the front cover 10 is rotated upwards and, thus, the lamp assembly 20 is exposed to the outside of the front cover 10. Subsequently, when the screws 23 fastening the lamp cover 50 to the bottom of the lamp casing 30 are unfastened, access to the lamps 21 is provided to the user and, thus, the lamps 21 may be removed from the sockets 22.

Figure 5:
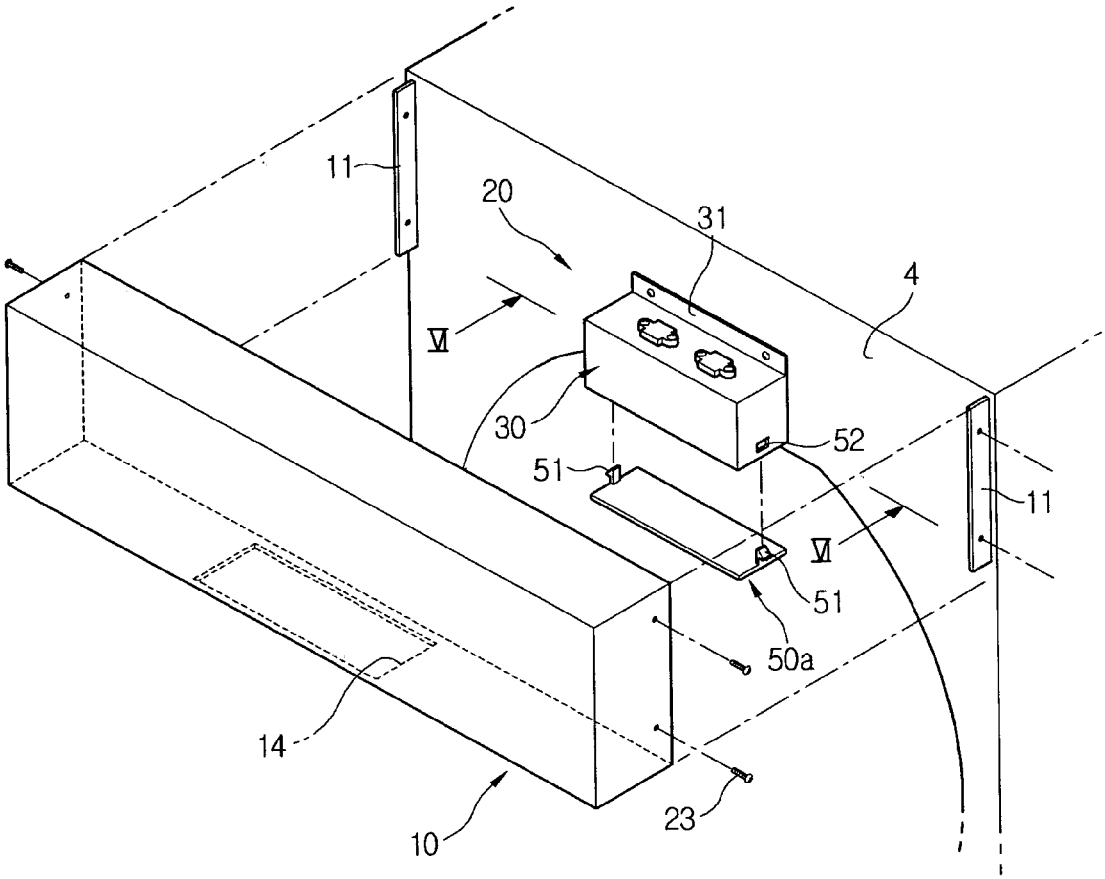
FIG. 5 is a partial perspective view showing a lamp assembly mounted in a front cover, according to a second embodiment of the present invention.
Figure 6:
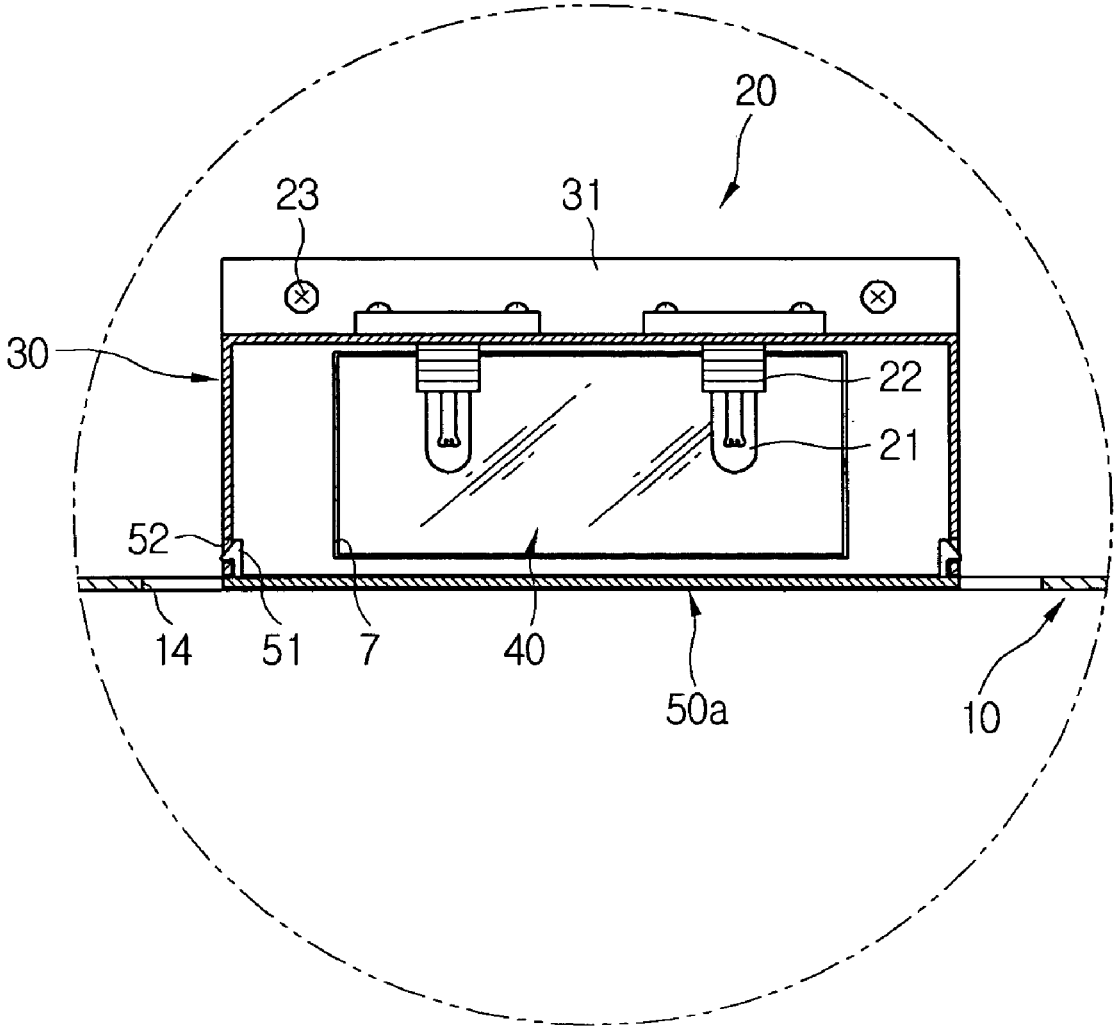
FIG. 6 is a cross-sectional view of the lamp assembly taken along line VI—VI of FIG. 5.

FIGS. 5 and 6 are views showing the lamp assembly 20 according to a second embodiment of the present invention, which is located in the front panel 4. The lamp assembly 20 according to the second embodiment of the present invention is identical to the lamp assembly 20 according to the first embodiment of the present invention, except for the fastening structure of a lamp cover 50*a* and the installation structure of the front cover 10. Accordingly, only the fastening structure of the lamp cover 50*a* and the installation structure of the front cover 10 are described below.

Like the lamp assembly 20 according to the first embodiment, the lamp assembly 20 according to the second embodiment includes a lamp casing 30 to accommodate lamps 21, which is mounted on the front panel 4, a transparent panel 40 to cover the irradiation hole 7 (refer to FIG. 2), and a lamp cover 50*a* to cover a bottom of the lamp casing 30.

Hooks 51 projected upwardly are formed on both ends of the lamp cover 50*a*, while hook holes 52 are formed in lower portions of both sides of the lamp casing 30 to correspond to the hooks 51.

Accordingly, when the lamp cover 50*a* is forced upward below the lamp casing 30, the hooks 51 engage the hook holes 52 and, thus, the lamp cover 50*a* engages the bottom of the lamp casing 30. See FIG. 6. When the hooks 51 are pushed inwardly, the hooks 51 detach from the hook holes 52 and, thus, the lamp cover 50*a* is removed from the lamp casing 30.

The front cover 10 is fastened to the front panel 4 by fastening both sides of the front cover 10 to tabs 11 projected from both ends of the front panel 4, which are provided with screw holes.

To replace the lamps 21 with the front cover 10 fastened to the front panel 4, an opening 14 that is larger than the lamp cover 50*a* is formed in a bottom surface of the front cover 10 to correspond to the lamp cover 50*a*.

After the lamp cover 50*a* is removed from the lamp casing 30 by forcing inwardly the hooks 51 of the lamp cover 50*a* and removing the lamp cover 50*a* through the opening 14 of the front cover 10, the lamps 21 may be easily removed from the lamp casing 30.

As described in detail above, in the cooking apparatus of the present invention, a lamp assembly is mounted on a front panel in front of a cooking cavity, so that a mounting hole does not need to be formed in an inner wall of the cooking cavity to mount the lamp assembly in the cooking cavity, thus reducing the loss of heat from the cooking cavity and allowing the cooking cavity to have a curved shape, which adds variety to the appearance of the cooking apparatus.

Furthermore, the cooking apparatus of the present invention allows lamps to be conveniently replaced in the lamp assembly, thus increasing consumer satisfaction with the cooking apparatus.

Although two embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus, comprising:

a cooking cavity open in a front thereof;

a front panel defining a front periphery of the cooking cavity, and having an irradiation hole; and a lamp assembly mounted on an outer surface of the front panel to illuminate the cooking cavity from the front panel, the lamp assembly comprising:

a lamp casing accommodating at least one lamp removably inserted therein and covering a space in front of the irradiation hole; and a transparent plate covering the irradiation hole.

2. The cooking apparatus of claim 1, wherein the front panel has an irradiation hole in an upper portion of the front panel.

3. The cooking apparatus of claim 2, wherein the transparent plate is made of a heat-resistant material and is attached to the front panel to close the irradiation hole.

4. The cooking apparatus of claim 2, wherein the lamp casing has a flange, extending from at least one edge of the lamp casing, with screw holes to attach the lamp casing to the front panel using screws.

5. The cooking apparatus of claim 2, wherein the lamp casing is attached to the front panel by welding edges of the lamp casing to the front panel.

6. The cooking apparatus of claim 2, wherein:

the lamp casing is open at a back and a bottom thereof;

the lamp casing has at least one socket, to which the at least one lamp is inserted, in an upper portion of an interior of the lamp casing; and the lamp casing has a lamp cover at the bottom of the lamp casing.

7. The cooking apparatus of claim 6, wherein the lamp cover is detachably attached to the bottom of the lamp casing by screws.

8. The cooking apparatus of claim 6, wherein:

the lamp casing has hook holes at both sides of the lamp casing; and the lamp cover has hooks to detachably engage the hook holes.

9. The cooking apparatus of claim 6, further comprising a front cover detachably attached to the front panel to surround the lamp assembly.

10. The cooking apparatus of claim 9, wherein the front cover is hinged to the front panel at both sides of an upper end of the front panel, and is screwed to the front panel at both sides of a lower end of the front cover to expose the lamp assembly to an outside of the front cover by rotating the front cover upwards after unscrewing the front cover at the both sides of the lower end of the front cover.

11. The cooking apparatus of claim 9, wherein the front cover is screwed to the front panel at both sides of an upper end of the front panel and at both sides of a lower end of the front cover to expose the lamp assembly to an outside of the front cover by unscrewing screws from the front cover to separate the front cover from the front panel.

12. The cooking apparatus of claim 9, wherein a bottom of the front cover and a bottom of the lamp casing are arranged on an upper portion of the front panel to correspond to each other and the front cover has an opening at the bottom of the front cover, to allow access to the bottom of the lamp casing with the front cover attached to the front panel.

13. The cooking apparatus of claim 1, wherein the cooking cavity has a curved shape.

14. The cooking apparatus of claim 1, wherein the cooking cavity is supplied with overheated steam to cook food.

15. The cooking apparatus of claim 8, further comprising tabs projecting from both ends of the front panel, the tabs having screw holes to fasten the front cover to the front panel.

16. The cooking apparatus of claim 12, wherein access is provided to the at least one lamp by removing the lamp cover, the lamp cover being removed from the lamp casing by pushing the hooks inwardly through the hook holes and removing the lamp cover through the opening on the front cover.

17. A lamp assembly for a cooking apparatus having a front panel defining a front periphery of a cooking cavity and an irradiation hole in the front panel, the lamp assembly comprising:

a lamp casing accommodating one or more lamps and surrounding the irradiation hole;

a transparent plate at a back of the lamp casing to cover the irradiation hole; and a lamp cover detachably attached to a bottom of the lamp casing.

18. The lamp assembly of claim 17, wherein the one or more lamps are accessed by removing the screws from the lamp cover and detaching the lamp cover from the lamp casing.

19. A lamp assembly for a cooking apparatus having a front panel defining a front periphery of a cooking cavity, an irradiation hole in the front panel, and a front cover detachably attached to the front panel with an opening in a bottom of the front cover, the lamp assembly comprising:

a lamp casing accommodating one or more lamps and surrounding the irradiation hole, the lamp casing having hook holes at both sides thereof;

a transparent plate at a back of the lamp casing to cover the irradiation hole; and a lamp cover detachably attached to a bottom of the lamp casing, the lamp cover having hooks at both ends thereof that engage the hook holes, the lamp cover having a smaller size than the opening in the bottom of the front cover, and the lamp cover being adjacent to the opening in the bottom of the front cover when the front cover is attached to the front panel.

20. The lamp assembly of claim 19, wherein the one or more lamps are accessed by pushing the hooks inwardly through the hook holes and removing the lamp cover through the opening in the bottom of the front cover.

21. A cooking apparatus, comprising:

a cooking cavity open in a front thereof, a front panel defining a front periphery of the cooking cavity;

a lamp assembly mounted on the front panel to illuminate the cooking cavity from the front panel; and a front cover located in front of the upper portion of the front panel to cover the lamp assembly.

* * * * *